US005751008A

United States Patent [19]

Jung et al.

[11] Patent Number: 5,751,008

[45] Date of Patent: May 12, 1998

[54] ULTRAVIOLET EMITTER

[75] Inventors: Joachim Jung; Bernd Schwarz, both of Nurtingen, Germany

[73] Assignee: IST Strahlentechnik Metz GmbH, Nurtingen, Germany

[21] Appl. No.: 640,630

[22] Filed: May 1, 1996

[30] Foreign Application Priority Data

May 4, 1995 [DE] Germany ..... 195 16 053.3

[51] Int. Cl.[6] ..... H05B 31/04

[52] U.S. Cl. ..... 250/504 R; 34/278

[58] Field of Search ..... 250/504 R, 503.1, 250/493.1, 495.1; 34/275, 276, 277, 278, 420

[56] References Cited

U.S. PATENT DOCUMENTS

| | | | |
|---|---|---|---|
| 4,434,562 | 3/1984 | Bubley et al. | 34/278 |
| 5,343,629 | 9/1994 | Rae | 34/278 |
| 5,440,137 | 8/1995 | Sowers | 250/504 R |

FOREIGN PATENT DOCUMENTS

| | | |
|---|---|---|
| 0416868 | 3/1991 | European Pat. Off. . |
| 2370071 | 6/1978 | France . |
| 2403529 | 4/1979 | France . |
| 8318696 | 11/1983 | Germany . |
| 3509939 | 9/1986 | Germany . |
| 3744799 | 6/1989 | Germany . |
| 2258296 | 2/1993 | United Kingdom . |
| 9112897 | 9/1991 | WIPO . |

*Primary Examiner*—Kiet T. Nguyen

*Attorney, Agent, or Firm*—Roylance, Abrams, Berdo & Goodman, L.L.P.

[57] ABSTRACT

A UV emitter for drying surface-treated substrates has a housing with an opening aligned toward the substrate. A radiation source is arranged within the housing. At least one air outlet is provided at the opening for an air current sweeping over the opening.

21 Claims, 1 Drawing Sheet

ULTRAVIOLET EMITTER

BACKGROUND OF THE INVENTION

Ultraviolet (UV) emitters are used as drying means in printing or finishing endless products or long (printing) machinery primer parts. For example in printing presses, ultraviolet drying is used on the printed or finished sheets of paper. Normally, following treatment of their surfaces, the substrates are exposed to the UV emitter only for sufficient time for the UV radiation to be able to generate a chemical reaction in the surface treatment. Additional heat coming out of the UV emitter does not damage the substrate, for example, by causing the sheet to become yellow or by even igniting the substrate. However, if production comes to a stop, for example because of a break in the transport of the substrate, then the part of the substrate which is at this instant being subjected to UV radiation must be protected from the heat of the UV emitter.

One known UV emitter of this type comprises a radiation source arranged within a housing. The radiation source emits its radiation through an opening in the housing. Therefore, the UV emitter has mechanical flap valves for closing the opening in the housing.

Technical advancement has produced progressively smaller and more compact units for application of the surface treatment. As a result, progressively less space is available for the UV emitter.

SUMMARY OF THE INVENTION

Objects of the present invention are to provide an improved and compact UV emitter requiring less space.

The foregoing objects are basically obtained by an ultraviolet emitter for drying surface-treated substrates, comprising a housing with an opening, and a radiation source arranged within the housing for emitting radiation through the opening and against a substrate aligned with the opening. A first air outlet means is mounted adjacent the opening for passing a first air current over the opening.

This air current chokes out the convection of warmer air generated by the radiation source when it comes out of the UV emitter and into the treated substrate. The mechanical flap valves, swivelling reflectors or diaphragms which were previously required are omitted. Such omission reduces the dimensions and weight of the UV emitter, and considerably simplifies the construction of the UV emitter.

To prevent heating up of the substrate by the infrared radiation generated from the radiation source, it is advantageous to have at least one additional air outlet for an air current which impinges on the substrate.

To reduce the UV radiation to which the substrate is exposed, it is advantageous that the radiation source, in addition to a disconnected mode and an operational mode, also embody at least one standby mode. The standby mode has reduced radiation capacity compared with the operational mode. One especially advantageous arrangement includes a top standby mode, in which the radiation source burns with decreased capacity for a short halt in production, and a bottom standby mode with still further reduced radiation capacity for a more lengthy shutdown of the surface treatment unit. The life of the radiation source is lengthened with these measures. At the same time the use of electric power is decreased.

It is advantageous to provide an arrangement to act upon the radiation source with an air current to provide cooling. The adaptation of the air cooling to the power capacity of the radiation source in standby operation mode, even with very low capacities, also facilitates emitter-saving operation over a longer period of time.

The UV emitter of the invention is preferably incorporated as a drying unit in a device intended for surface treatment of substrates.

Other objects, advantages and salient features of the present invention will become apparent from the following detailed description, which, taken in conjunction with the annexed drawing, discloses a preferred embodiment of the present invention.

BRIEF DESCRIPTION OF THE DRAWING

Referring to the drawing which forms a part of this disclosure.

DETAILED DESCRIPTION OF THE INVENTION

Figure 1:
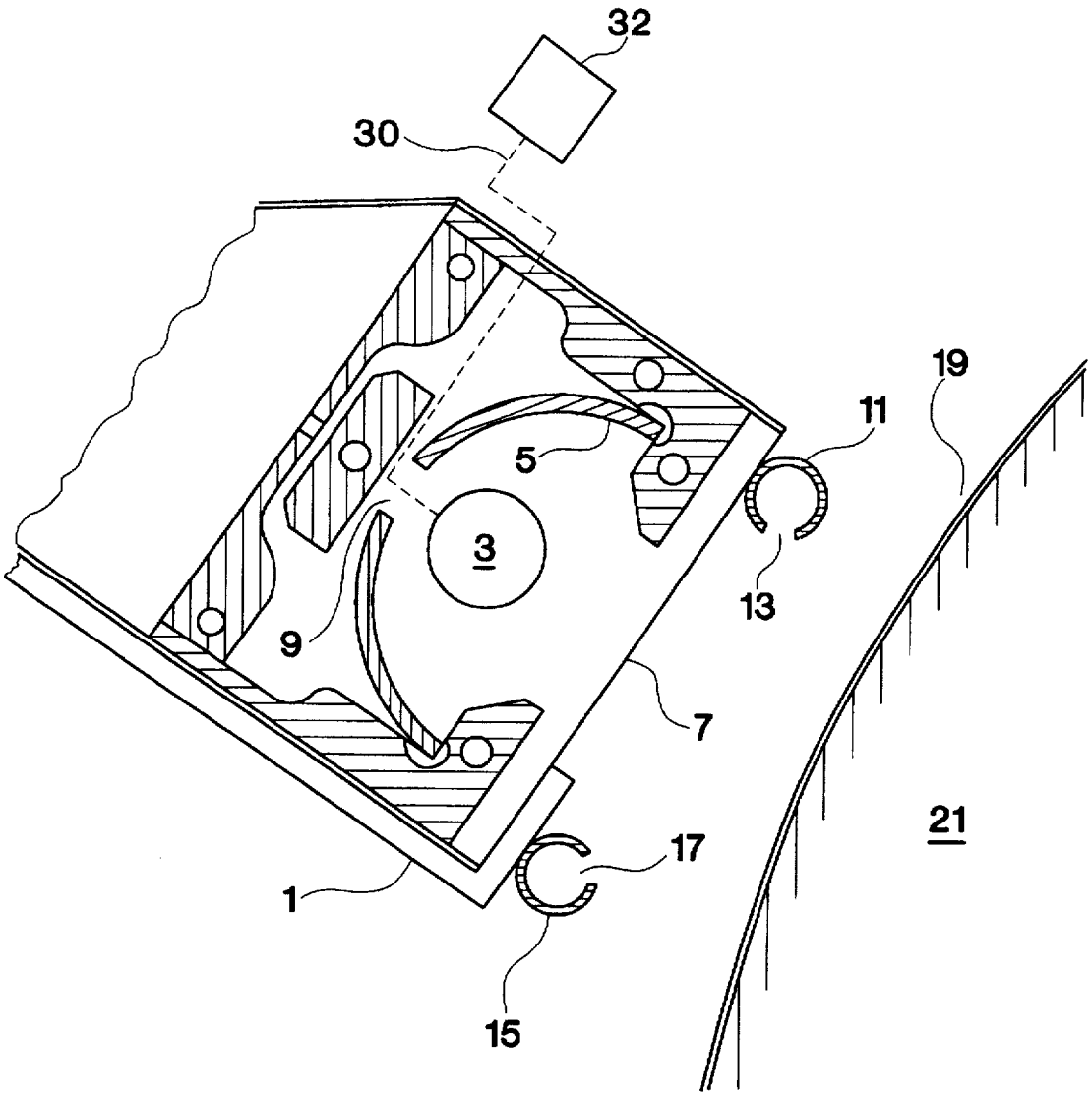
FIG. 1 is a side elevational view in section of an ultraviolet emitter according to the present invention.

The illustrated embodiment shows a UV emitter in a printing press for sheets of paper.

An elongated high pressure gas discharge lamp serves as the radiation source 3. The radiation source, for example a mercury vapor lamp, is arranged in a housing 1. Radiation source 3 is partially surrounded longitudinally by a semi-cylindrical reflector 5, which is covered with reflective metal on its interior surface. Radiation source 3 is aligned approximately with the focal point of reflector 5.

Reflector 5 is arranged with its open longitudinal side aligned with an opening 7 in housing 1. The emissions from radiation source 3 can be emitted directly or through reflection on reflector 5 out of opening 7. On its side opposite or remote from opening 7, reflector 5 has a clearance 9. Clearance 9 allows the passage of air, through which an air current can pass, to cool radiation source 3.

Opening 7 is required to be of rectangular shape to correspond with the elongated shape of radiation source 3. A first pipe 11 is arranged along one edge of opening 7 which corresponds to one longitudinal side of the rectangle. Preferably, cold compressed air can be passed through conduits (not shown) into the first pipe. First pipe 11 is provided with a longitudinal air outlet 13, aligned with and directed toward the opposite edge of opening 7, to pass an air current over opening 7. In the exemplary embodiment, air outlet 13 comprises a plurality of apertures arranged in series one after the other with identical spacing between them.

A second pipe 15 is provided on housing 11 on the side of opening 7 opposite first pipe 11. Similar to first pipe 13, the second pipe can have compressed air flowing through it, and has an additional air outlet 17 extending in longitudinal direction of the second pipe for discharge of a flowing air current.

A plurality of coolant passages are provided in the wall of housing 1. The coolant passages extend parallel to radiation source 3 for cooling housing 1.

The UV emitter is arranged within a unit for surface treatment of a substrate 19. In the exemplary embodiment, the UV emitter is within the printing press itself, with radiation source 3 extending parallel to the rotational axis of a roller 21. The treated substrate 19, in the form of a printed paper sheet, is conveyed over roller 21 past the UV emitter. Opening 7 in housing 1 is aligned with substrate 19. The additional air outlet 17 is configured on second pipe 15 such that the air current coming out of it impinges on substrate 19 approximately in the same area toward which opening 7 is directed. This air current cools substrate 19 and, at the same time, cools roller 21. If desired, the air current can also cool other parts of the printing press.

Before radiation source 3, in the current circuit 30 feeding the radiation source, a power supply unit 32 is provided. The power supply unit can adjust the output of radiation source 3 by modifying the voltage, current or frequency supplied to the radiation source. Therefore, radiation source 3, in addition to a disconnected mode or state and an operational mode or state, also has two more modes or states, a top standby mode or state and a bottom standby mode or state. In the top standby mode the capacity of radiation source 3 is reduced to approximately 15 percent of normal radiation source output in the operational mode. The current intensity is set so that radiation source 3 in top standby mode continues to burn steadily. Thus, radiation source 3 can switch over in a few seconds from its top standby mode into its operational mode.

In bottom standby mode, the radiation source output is reduced to approximately 1 percent to 3 percent of the normal radiation source output. The actual required time for the changeover into operational mode from the bottom standby mode is increased. However, radiation source 3 can continue in emitter-saving operation over several hours in its bottom standby mode, without requiring disconnection of radiation source 3 because of heat build-up. This operation increases the life of radiation source 3 and saves electrical power. Relative to the power supply to perform this operation, the subject matter of U.S. patent application Ser. No. 08/640,631 of Wolfgang Heering and Peter Schwarz, filed concurrently herewith and entitled Method and Circuit Arrangement for Operating High Pressure Gas Discharge Lamp, is hereby incorporated by reference.

If the printing press comes to a halt, radiation source 3 switches from its operational mode into top standby mode. The air current coming out of air outlet 13 of first pipe 11 acts as a curtain closing off opening 7 from the convection of warm air. The air current coming out of air outlet 17 of second pipe 15 cools substrate 19 and protects it from infrared radiation coming from radiation source 3. The air current coming through air clearance 9 cools radiation source 3.

If the printing press remains shut down for several minutes, the power supply unit switches radiation source 3 from its top standby mode to its bottom standby mode. When the printing press is again operating, the power supply unit brings radiation source 3 back into an operational mode with normal output. According to this arrangement and method of operation of the printing press and the UV emitter, one or more of the described air currents can be deleted.

While one embodiment has been chosen to illustrate the invention, it will be understood by those skilled in the art that various changes and modifications can be made therein without departing from the scope of the invention as defined in the appended claims.

What is claimed is:

1. An ultraviolet emitter for drying surface-treated substrates, comprising:

a housing with an opening;

a radiation source arranged within said housing for emitting radiation in an emitting direction through said opening and against a substrate aligned with said opening; and a first air outlet means, mounted adjacent said opening, for passing a first air current over said opening and across said emitting direction.

2. An ultraviolet emitter according to a claim 1 further comprising:

a second air outlet means mounted adjacent said opening for directing a second air current against the substrate at a location aligned directly under said radiation source.

3. An ultraviolet emitter according to claim 1 wherein said radiation source can be selectively operated in a normal operational mode with a normal radiation output, a disconnected mode with no radiation output, and a first standby mode with a first reduced radiation output less than said normal radiation output.

4. An ultraviolet emitter according to claim 3 wherein said radiation source can be switched from said normal operational mode to the first standby mode without being extinguished.

5. An ultraviolet emitter according to claim 4 wherein said radiation source can be operated at a second standby mode with a second reduced radiation output different from said first reduced radiation output.

6. An ultraviolet emitter according to claim 3 wherein said radiation source can be operated at a second standby mode with a second reduced radiation output different from said first reduced radiation output.

7. An ultraviolet emitter according to claim 1 wherein said housing comprises air means to cool said radiation source with an air current.

8. An ultraviolet emitter according to claim 1 wherein said opening in said housing has first and second opposite edges, said first air outlet means being mounted along said first edge for passing said first air current directly toward said second edge.

9. An ultraviolet emitter according to claim 1 wherein said first outlet means passes said first air current directly across and parallel to said opening in said housing.

10. An ultraviolet emitter according to claim 1 wherein said opening is uncovered; and said first air current acts as a curtain to close said opening.

11. A device for drying surface-treated substrates, comprising:

a substrate support;

a housing with an opening aligned with the substrate support;

a radiation source arranged within said housing for emitting radiation in an emitting direction through said opening and against a substrate on said substrate support; and a first air outlet means, mounted adjacent said opening, for passing a first air current over said opening, and across said emitting direction.

12. A device according to claim 11 further comprising:

a second air outlet means mounted adjacent said opening for directing a second air current against said substrate support at a location aligned directly under said radiation source.

13. A device according to claim 11 wherein said radiation source can be selectively operated in a normal operational mode with a normal radiation output, a disconnected mode with no radiation output, and a first standby mode with a first reduced radiation output less than said normal radiation output.

14. A device according to claim 13 wherein said radiation source can be switched from said normal operational mode to the first standby mode without being extinguished.

15. A device according to claim 14 wherein said radiation source can be operated at a second standby mode with a second reduced radiation output different from said first reduced radiation output.

16. A device according to claim 13 wherein said radiation source can be operated at a second standby mode with a second reduced radiation output different from said first reduced radiation output.

17. A device according to claim 11 wherein said housing comprises air means to cool said radiation source with an air current.

18. A device according to claim 11 wherein said opening in said housing has first and second opposite edges, said first air outlet means being mounted along said first edge for passing said first air current directly toward said second edge.

19. A device according to claim 11 wherein said first outlet means passes said first air current directly across and parallel to said opening in said housing.

20. A device according to claim 11 wherein said opening is uncovered; and said first air current acts as a curtain to close said opening.

21. A device according to claim 11 wherein said substrate support selection moves said substrate relative to said radiation source;

said first outlet means passes said first air current when movement of the substrate is halted and stops said first air current when the substrate is moving.

* * * * *